United States Patent [19]

Schultz

[11] 4,161,852

[45] Jul. 24, 1979

[54] ADOBE WALL CONSTRUCTION

[76] Inventor: Karl V. Schultz, 18322 Carlwyn Dr., Castro Valley, Calif. 94546

[21] Appl. No.: 842,674

[22] Filed: Oct. 17, 1977

[51] Int. Cl.[2] ..... E04B 1/00

[52] U.S. Cl. ..... 52/250; 52/293; 52/414; 52/741

[58] Field of Search ..... 52/378, 380, 381, 382, 52/383, 741, 745, 414, 422, 600, 612, 242, 425, 426, 743, 293, 250

[56] References Cited

U.S. PATENT DOCUMENTS

| | | | |
|---|---|---|---|
| 1,530,662 | 3/1925 | Gibbons et al. | 52/743 |
| 2,101,073 | 12/1937 | Kotrbaty | 52/381 X |
| 2,116,557 | 5/1938 | Billner | 52/383 X |
| 3,559,355 | 2/1971 | Day, Jr. | 52/378 X |

FOREIGN PATENT DOCUMENTS

| | | | |
|---|---|---|---|
| 2309678 | 11/1976 | France | 52/378 |

OTHER PUBLICATIONS

"West Coast Houses Get Down to Earth", *Construction Methods,* p. 110, Jul. 1947.

*Primary Examiner*—Carl D. Friedman
*Attorney, Agent, or Firm*—Robyn Wilcox; Jay Cantor

[57] ABSTRACT

This invention relates to a mud, or, as it is commonly known in the West, "adobe", construction. The present invention relates to a method of constructing such a wall with interior wire reinforcements which are adapted to tie the foundation, the wall and a roof member, such as a roof truss, into an integral assembly. It includes a series of formed wire "trusses", or tie members, arranged in spaced relationship along the wall extending from a point within the foundation form to a height to include at least one member of the roof truss. Cooperating with the trusses are a pair of laterally spaced, longitudinally extending wire mesh members, the trusses and wire mesh being suitably tied together to form an integral structure. The wall is constructed either by pouring adobe mud into a form, or by plastering a thick adobe mud onto the wire mesh, which will extend through that material and lock itself into it in courses of about twelve inches high. When the next course is placed on the wire mesh, the space between the two adobe walls is filled with more adobe to form a solid wall as it rises. When the wall, including the wall cap beam, is in place, roof truss members are threaded into, or otherwise attached to, the upper ends of the wire truss, thereby locking the roof beam to the wall and the foundation in a unitary structure.

7 Claims, 11 Drawing Figures

ADOBE WALL CONSTRUCTION

BACKGROUND OF THE INVENTION

Prior to the coming of the Spaniards to this continent, many of the Indians of our Southwest constructed houses of mud. For the most part, their construction consisted of an outline of the walls with branches, cactus ribs, reeds, or the like, strung between corner posts and then covering the framework so constructed with mud on both sides. The resultant wall was usually about six or more inches in thickness and provided a house which, when roofed over, had remarkable air-conditioning properties and was weatherproof and fireproof.

When the Spanish came to this area, they modified this old type of structure by constructing adobe bricks, usually of approximately four inches in thickness by twelve inches in width and sixteen or eighteen inches in length. These bricks were thoroughly dried and then laid one upon another to form a wall, the adobe bricks being mortared together with mud. This type of structure was very common in the old Southwest and is still used to a greater extent than is usually realized, because it can be made of local materials by unskilled labor; is completely fireproof and weatherproof; and, in that climate, will stand for generations even without plastering. Such a building has great thermal insulation properties and is therefore very popular because it is cool throughout the summer and warm in winter. This type of construction has little earthquake strength and was therefore replaced in the earthquake areas by wood, or frame buildings which, in past years, were rather inexpensive but is now becoming quite expensive.

At the present time, due to the expense of the frame or reinforced brick construction, adobe buildings are attracting considerably more attention and many homes and public buildings are being constructed of adobe. This is particularly true when the building is only one story in height.

Recent developments have tended to increase the use of what is often called "poured mud" construction. This type of construction is more closely related to the pre-Spanish Indian type in which the adobe mud, instead of being cast into bricks and dried, is poured around an inexpensive reinforcing structure to form an integral reinforced wall. It is commonly known as a "poured adobe" wall and retains all the advantages of the old Indian plaster mud and the Spanish adobe brick of the past. It is virtually waterproof, has great heat and sound insulation properties, is fireproof, termite-proof and has high compression and shear strength. The reinforcing of the wall can render it quite resistant to earthquake destruction, depending upon the type of reinforcing utilized.

One of the recent developments in this field is in the use of an emulsified asphalt in the mud mix to render the walls made of this mix completely waterproof and very highly resistant to water errosion. Some work is being done at present on the use of other additives that would be cheaper or more efficient than emulsified asphalt and yet render the adobe material completely resistant to moisture, water errosion, abrasion, etc. Also, much work is being done toward the development of less expensive reinforcing materials.

Heretofore, the reinforced adobe walls have been reinforced by laying steel reinforcing rods horizontally between courses approximately two feet apart. The ends of the rods are encased in a concrete post poured later to make a unitary wall. Such construction is rather expensive, requires the use of reinforcing steel, and is not practical in under-developed countries or areas in our own country requiring low-cost or owner-built construction.

It has also been suggested that the use of a wire reinforcement, such as wire mesh, extending vertically in a poured wall is sufficient. Such construction does not have the integral strength against earthquake damage that comes from the use of reinforcing steel rods, the ends of which are embedded in concrete posts. It has also been suggested to use pre-formed parallel wire mesh which are tied together by some suitable means, such as welded or tied rods, and forming the wall around it or on it. Such construction is rather awkward to make and the reinforcement is in the way of construction.

The structure of my invention includes hanging a series of wire trusses on a wire stretched between corner posts of the wall, preferably a truss about every six to twelve inches along the length of the wall. Wire mesh, either of 1"×1" or 1"×2" size, is affixed to both sides of the wire truss, as by placing a short iron pin or nail between the apex of a truss and the wire mesh. Obviously, many different ways of affixing the wire mesh to the wire truss are available and could be used interchangeably. Rough door framing, window framing, and other wall apertures are hung on the wire truss and the wall will be constructed around them and the truss members within such a frame will be cut away after the wall is completed.

The wall can be constructed by using a form and pouring and compacting the adobe mud into it. In this type of construction it is usual to pour material for a depth of about a foot, or maybe two, and after the wall has dried sufficiently, remove the form to the adjacent location and proceed around the wall. By the time construction gets around to the section first poured, the wall is usually dry enough to place the form on top of the first course and pour a second, etc. Another type of construction is to form a very stiff mud and to plaster or press it through the wire mesh. In this form it is not necessary to completely fill the interior of the wall as the wire mesh will support a wall of proper mud consistency for a height of about a foot without slumping, then when the worker returns to the first course, it will have dried sufficiently to permit it to be used as a form to fill the interior space with mud to form a solid wall and then to plaster another foot or so of mud onto the form.

When the adobe wall is constructed, it is preferred to cap it either with a wooden beam or a bond beam of reinforced concrete. In this case, the top part of the wire truss will extend above the cap beam and is used to attach the roof truss to the reinforcing which extends from the foundation up through the wall. This forms an integral foundation wall roof structure which greatly resists earthquake damage and still retains all of the other advantages of adobe construction.

OBJECTS

It is a primary object of the present invention to provide a method of adobe construction which reinforces the adobe wall and simultaneously ties the reinforcement of the wall into the foundation and onto the roof truss, thereby tying the three elements into one integral structure which greatly increases resistance to earthquake destruction.

It is another important object of the present invention to combine a common and inexpensive mass produced reinforcing, such as welded wire mesh and wire, with a moldable material, such as adobe, to provide a wall of much greater strength.

It is another important object to provide reinforcing for a poured or plastered adobe wall which does not appreciably affect the ease of construction of the wall.

It is another important object of the present invention to provide a reinforcing structure for an adobe wall that is readily adaptable to either poured (into a form) or a plastered-type of construction.

It is another important object of the present invention to provide an adobe wall that can be easily constructed by unskilled workmen, which is inexpensive and relies on local materials.

It is a more specific object of the present invention to develop a simple method of mechanically linking and locking two panels of wire mesh to each other in a manner which: (a) keeps them in a fixed space relationship; (b) permits the distance between the panels to be varied with the thickness of the wall; (c) adds structural strength to the skeleton thus formed; (d) permits the panels of wire mesh to be linked and locked to each other easily and in a continuous manner on the construction site; (e) does not weaken the existing prewelded joints in the wire mesh; (f) does not destroy the corrosion resistant galvanized coating on the welded wire mesh; (g) does not require expensive or high technology equipment in the process of erecting the skeleton; and (h) permits simple erection of walls of differing heights, roof design or general architectural characteristics.

It is a further object to design such a skeleton of wire mesh and wire trusses that permits the wet adobe mix to be applied by pouring or plastering directly onto the skeleton. When the adobe is cured, this method results in a reinforced unitary structure (wall, floor or roof) which eliminates the labor intensive block molding and mortaring steps used in conventional adobe construction.

It is another object to provide an adobe construction technology which can be carried out with simple training methods for relatively unskilled workmen, using inexpensive materials and locally available materials, and which permits a high degree of component fabrication on or near the building site.

These and other objects of the invention will be apparent from the description and claims which follow.

FIGURES

Figure 10:
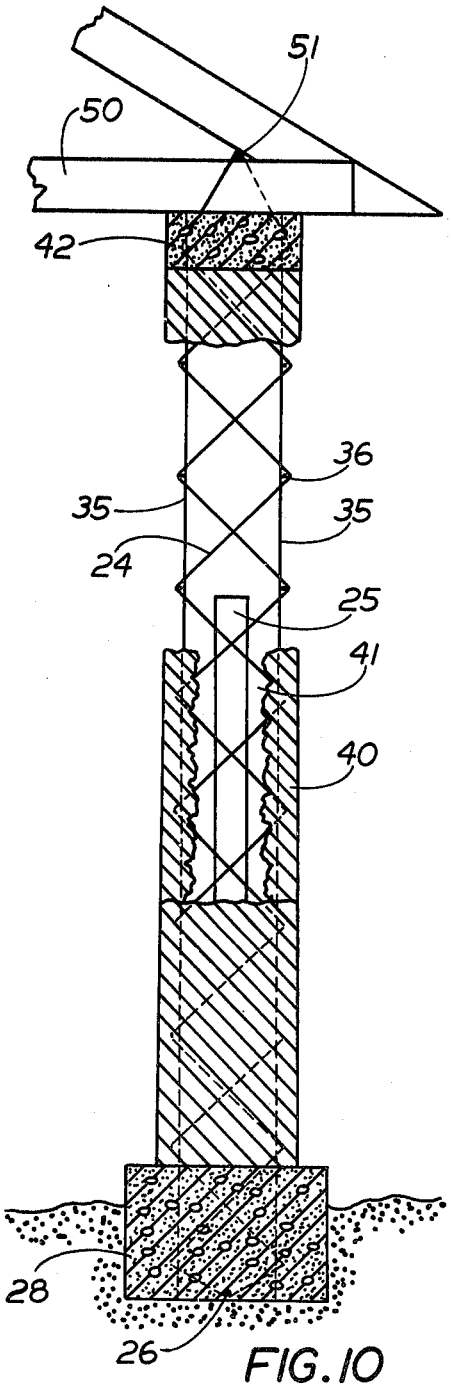
Figure 11:
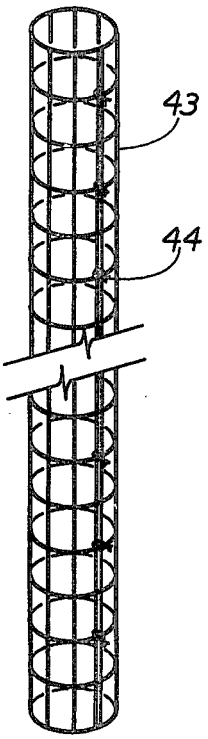

FIG. 10 is a sectional view of the wall formed by the present invention: the lower section showing a completely poured portion of the wall; a section of wall thereabove which shows the newly plastered adobe mud over the wire mesh; a third section of unpoured section of the wall and, at the very top, the completed wall with the wall tie beam in place and a portion of the roof truss affixed thereto; and FIG. 11 shows a detail of a reinforcing structure for use in the cylindrical holes left in the wall during its construction.

In the Southwestern portion of the United States, the term "adobe" includes not only the commonly known sun-dried mud brick, but also any of the stabilized soil types of construction, such as poured adobe or mud, or mud plastered over a supporting frame. In the present invention, the construction described will primarily refer to one in which the adobe mud is plastered onto a supporting wire mesh in courses of about twelve inches in height. It, of course, can also be made by pouring the mud into a form enclosing the mesh and trusses, again in courses of about twelve inches in height. It has been found in use that a stiff mud of proper consistency can be sufficiently self-supporting when so plastered. If there is a space between the dried faces of the wall, that can be filled at the time of plastering the next course upon the first by merely forcing mud down into the space. The adobe mud used is usually said to consist of about one-third clay and two-thirds sand mixed with a minimum amount of water. Actually, the clay may vary from twenty-five to forty-five percent of the dry mix, with the balance sand. Actually, of course, the proportion of sand to clay will vary from place-to-place as local materials are usually used. The dry mix is mixed with water or, preferably, water mixed with emulsified asphalt in the proportion of about four parts water to one of the emulsified asphalt. It can be noted that there are other materials that can be used in place of the emulsified asphalt as a waterproofing agent, such as several varieties of polymer, latex, acrylic, epoxy and resin-based additives. Normally, the emulsified asphalt is much cheaper than the others, so that it is normally used. The adobe can be strengthened by the addition of chopped straw, or other fibrous materials, such as pine needles, fiberglass, or the like, or by the addition of rice hulls or the like. These materials are thoroughly mixed to provide a stiff mud which can be used either in the formation of sun-dried bricks, usually about four inches thick, twelve inches wide and about sixteen to eighteen inches long. It can also be used as a plastering mud for the type of construction which will be herein described. Incidentally, it will be understood that other stiff, flowable materials could be used with this type of construction.

Adobe construction has many advantages, the first and most important of which is probably its inexpensiveness. It is made of local materials, can be made by unskilled labor working at the site. Such construction has high heat and sound insulation qualities, it is fireproof, termite-proof, has high crushing strength. Even without the addition of the emulsified asphalt, has good water-resistant qualities, although it is subject to errosion. With the addition of the emulsified asphalt, it can be made completely waterproof and highly resistant to water errosion. The primary disadvantage of this type of construction is its lack of strength against earthquake damage. However, when an adobe wall is reinforced as herein described, it becomes highly resistant to earthquake damage and, while the wall can be damaged as can any other type of construction, it is not likely to collapse upon the inhabitants within the building.

Figure 1:
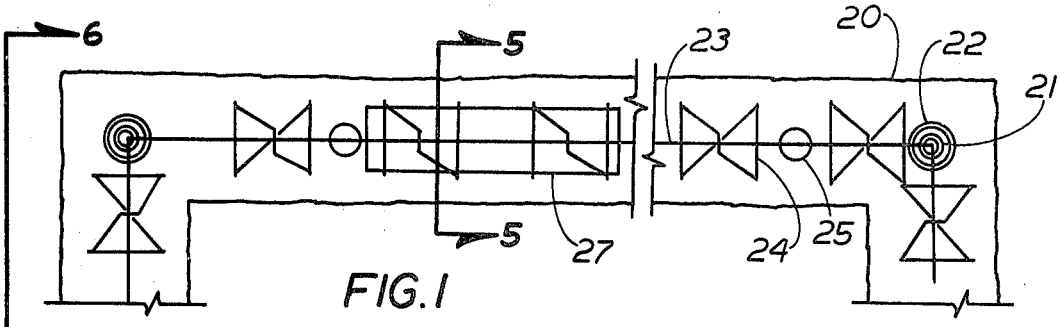
FIG. 1 shows the arrangement of the wire roof-wall-foundation trusses prior to the pouring of the foundation.
Figure 2:
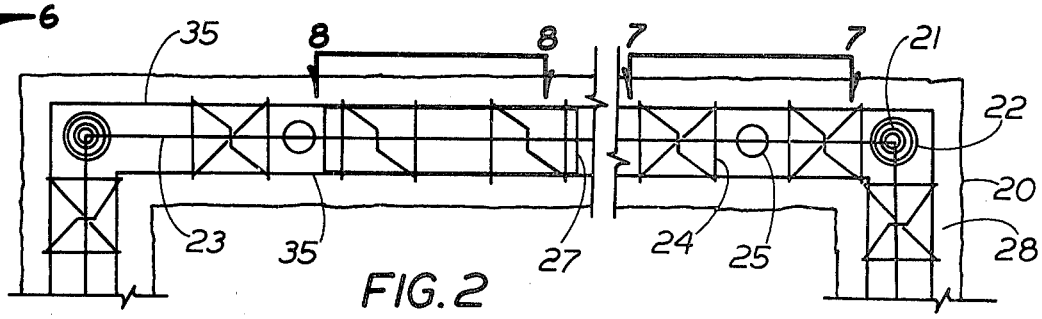
FIG. 2 is the same wall after the foundation has been poured.
Figure 3:
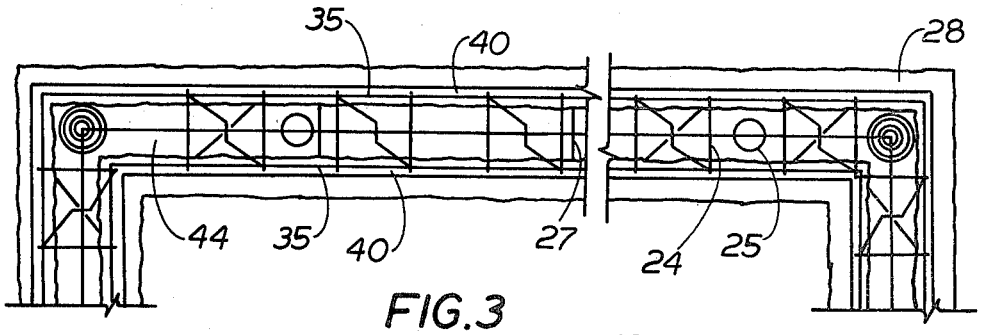
FIG. 3 is the same wall shown in FIG. 2 during various phases of construction, but before the roof cap, or bond beam, has been poured.
Figure 6:
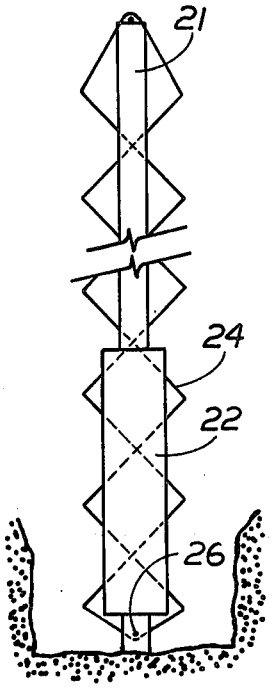
FIG. 6 is a sectional end view of the wire truss, such as taken along the plane indicated by the line 6—6 of FIG. 1.

Construction of an adobe wall begins with the excavation of a foundation trench 20. Corner posts 21 are set at the corners of the building. These posts are preferably of a height sufficient to include all of the wall plus that portion of the roof truss which is to be tied to the wall. The posts 21 are then enclosed in short sections of suitable pipe 22, which may be plastic, say, five or six inches in diameter, and perhaps two feet in length for purposes to be hereinafter described. A tie wire 23 is stretched between the upper ends of the posts 21, as shown in FIG. 1. A plurality of wire trusses 24, such as those shown and described in my copending application, filed on the same date as this, Ser. No. 842,675, and entitled "Wire Bending Tool", will be hung upon the wire 23. These trusses are entirely encased within the wall, and for a twelve-inch bearing wall would usually be approximately eight to ten inches square in their lateral dimensions. They are hung at spaced intervals upon the wire 23, usually about eight to twelve inches apart. I have found that the best and strongest wall is made by providing a wire truss at approximately eight to twelve-inch intervals throughout the length of the wall. These wire trusses are sufficiently long that the lower end lies within the trench 20 for the foundation. A steel reinforcing rod 26 is then threaded into the lower loops of the adjacent trusses 24 as shown in FIGS. 6 and 10. Thus, the foundation, when poured, will encompass not only the lower ends of the individual trusses, but will also encompass the tie rod 26 which will tie the lower ends of the trusses integrally into the foundation and thus tie the wall to the foundation. At this stage, the concrete foundation 28 may be poured, thus permanently integrating the various wire trusses 24 into the foundation.

Figure 5:
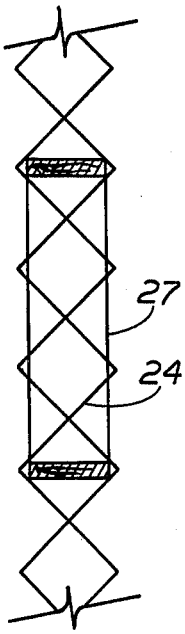
FIG. 5 is an end view of a portion of the trusses shown in FIG. 1 such as taken along a plane indicated by the line 5—5 of FIG. 1.

The next stage of construction involves the insertion of rough wooden door and window frames 27 into the wall wire trusses 24 at the proper locations. This is shown particularly in FIG. 8. In the preferred type of construction, the horizontal members of these frames are inserted between the apexes of the wire trusses 24 and the vertical members are placed between adjacent wire trusses as shown in FIGS. 1 and 5. A plurality of short lengths, such as about two feet in length, of plastic pipes 25 are placed on about four foot centers throughout the length of the wall. Also, at the beginning of this step, or even as soon as the foundation has started to set, the corner pipes 22 are lifted to rest upon the top of the foundation. These pipes will be readily lifted as the construction of the wall progresses to provide a continuous tube in the wall which will, after the top of the adobe wall is finished, be filled with reinforcement and concrete to also tie the wall together. It can be understood at this point that as adobe mud dries, it shrinks and cracks slightly, so that these tubes can be readily removed from a finished section of the wall and used in the next higher course.

Figure 7:
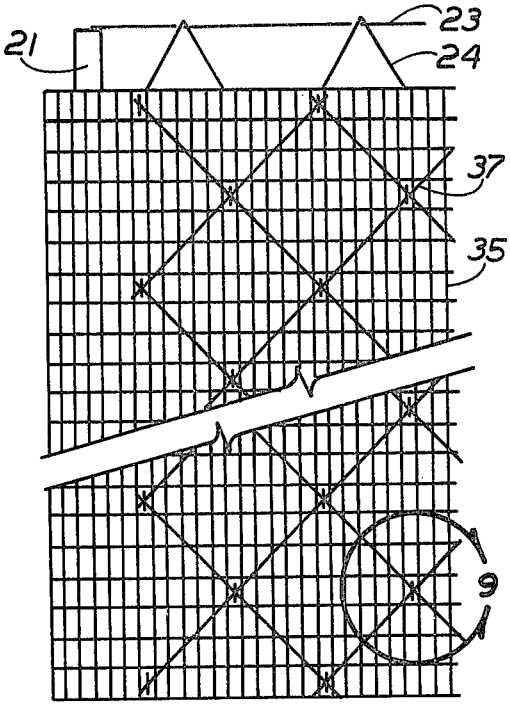
FIG. 7 is a side view of the wire mesh affixed to the wire trusses, in this case, by lengths of heavy wire, as along a plane indicated by line 7—7 of FIG. 2.
Figure 9:
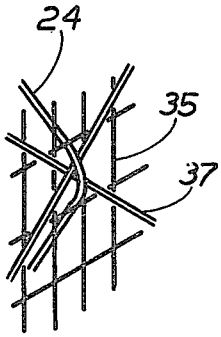
FIG. 9 is an enlarged perspective view of a method of affixing the wire mesh to the wire truss.
Figure 8:
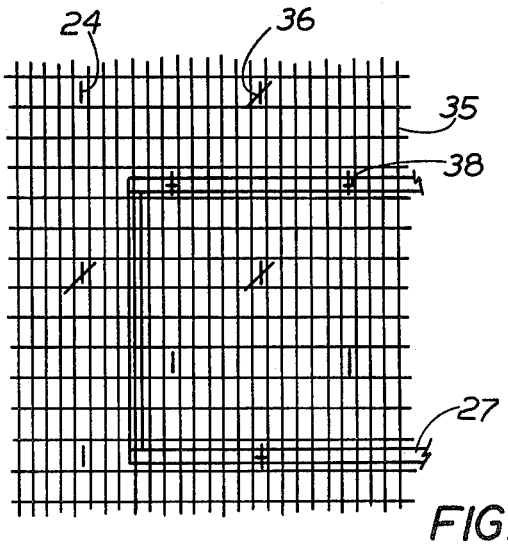
FIG. 8 is similar to FIG. 7 except that it shows a rough window frame in place in the construction as along a plane indicated by the line 8—8 of FIG. 2.

At this same stage of construction, a panel of wire mesh 35, such as 1"×1", 1"×2", or even 2"×4" in size, are stretched between the interior and exterior apexes of the wire trusses 24. The wire mesh is most conveniently purchased in widths of four feet, so that ordinarily the first panel will extend up to about one-half the height of the wall. When the adobe is up to a height of about three feet, an additional panel can be hung on the wire trusses 24 and tied by suitable means to the lower panel. In the preferred construction, a single parallel pair of the mesh panels will be stretched around the walls of the building and suspended on the wire trusses by any suitable means, such as nails or short pins 36 shown in FIG. 8, or small rods or heavy wire 37, as shown in FIG. 7. The wire mesh will be stapled to the wooden frames by staples 38, as shown in FIG. 8. If not previously done, the foundation should now be poured.

In the next stage of construction, the adobe wall is completed. Preferably, it is laid in course of approximately one foot in height, plastered through the mesh 35 on the interior and exterior of the walls. The adobe 40 expands as it penetrates through the mesh, as shown in the middle section of FIG. 10, and therefore ties the plastered outer faces of the wall to the parallel mesh panels. While sufficient force can be used in plastering to completely fill the void between the two mesh walls, normally this is not done, but the interior is left open, as shown in this section of FIG. 10. When the adobe is sufficiently stiff, it has been found that a one-foot height of wall will not slump appreciably and therefore makes a completely satisfactory wall.

If desired, of course, the wall can be poured between forms, not shown. When this is done, the forms are usually rather low, say, twelve or fourteen inches in height and are lifted from one course to the next higher one as the wall progresses upwardly. When the plastered construction is used and there is a space between the two faces of the wall, that space 41 can be filled when the adjacent higher course is made by simply filling the space between the two faces with more adobe and then plastering the adjacent course. FIG. 10 at the bottom shows a course in which the void between the two walls 40 has been filled and in the central section, shows the two walls which have not been filled. As the wall progresses upwardly, the short lengths of plastic pipe 25 can be lifted to an operative position, as by the time the lower course is dried, these forms can be readily removed.

It will be understood, of course, that no plastering would be done within the confines of the window and door frames, or other apertures, placed in the walls, although the wire trusses will extend vertically throughout the openings. After the wall is completed, wire cutters will be used to cut the trusses within these various openings and preferably the ends will be tightly stapled to the rough framing. Thus, the walls above and below these openings will be reinforced with the rest of the building and this reinforcement will be connected to the other trusses of the building. When the doors and windows are finished, the cut ends of the wire trusses 24 will be covered by the door and window framing.

When the height of the wall 40 approaches the top of the first four-foot mesh, a second mesh will be stretched around the building and affixed to the wire trusses and door and window framing as hereinbefore explained with regard to the first course. The two courses are then tied together with wire, preferably at about six inch locations. It is obvious that normally there will be an overlap of a few inches between the two respective courses of wire mesh 35 as the top course will terminate at the level of the wall cap, or bond beam.

Figure 4:
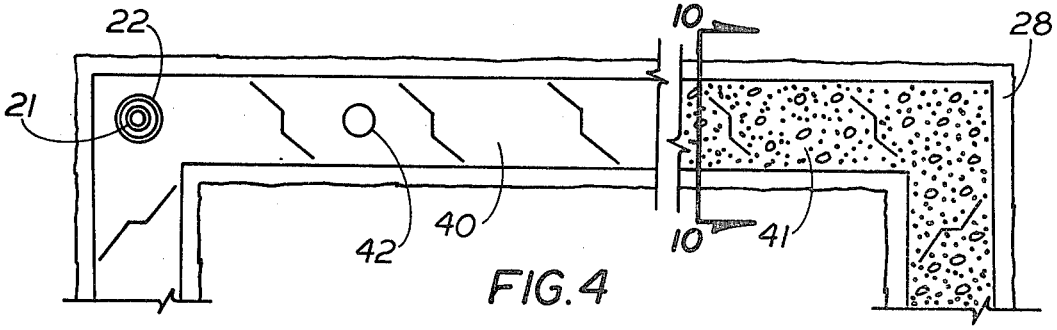
FIG. 4 is the same wall showing a portion of the roof cap in place.

When the adobe wall is finished to the desired height, as shown in FIGS. 4 and 10, it is preferred to remove the plastic pipes 25, and the suspension wire 23 is removed. This leaves the top of the wall free for the pouring of a concrete bond beam 41, as shown in part in FIG. 4. It also leaves a series of holes 42 extending from the foundation to the top of the wall. Prior to the pouring of the roof, or bond beam 41, the holes 42 left by the removal of the plastic pipes 25 should have some reinforcing material, such as the cylindrical wire reinforcing member 43 set into the holes 42 left by the removal of the pipes 25. The reinforcing members may be made of a short length of wire mesh tied, as at 44, to form a cylinder. This construction provides a series of reinforced concrete posts tying the wall and bond beam to the foundation.

The building is then completed by placing the roof trusses 50 upon the wall cap 42 and tying them to the upper loops of the wire trusses 24 by any suitable means, such as threading a rod 51 over a portion of the roof beam and threaded into the upper loops of the wire trusses 24. It is believed obvious that there are many ways of attaching the upper end of the wire truss to the roof truss or beam, such as by nailing, twisting ends of the truss over a beam, etc.

Usually the surface of the adobe wall will contain a number of small cracks which preferably are filled with a thin adobe coat, or plaster, which fills the cracks and gives a smooth and pleasantly appearing surface.

It is believed obvious to those skilled in the art that many minor variations can be made from the invention as herein particularly described. Such variations, such as the use of the various means for tying the mesh 35 to the wire trusses 24, the means of attaching the trusses to the foundation and roof beam, the method of constructing doors and window apertures, and the like, will be readily apparent to those skilled in the art.

What is claimed is:

1. An integral reinforcing means for a unitary foundation-reinforced solid adobe wall-roofing beam construction having:

(a) a foundation;

(b) a reinforced adobe wall extending upwardly from said foundation; and (c) a roofing beam resting upon the top of said wall; said integral reinforcing means comprising:

(1) a plurality of readily bendable upright wire trusses, the lower ends of which are embedded within said foundation and the upper ends of which are provided with a respective loop through which the roofing beam extends;

(2) a pair of spaced flexible wire mesh extending the length of said wall and loosely pinned to opposite sides of said wire trusses; and wherein the adobe wall is formed around said wire trusses and wire mesh.

2. The apparatus of claim 1 comprising also a plurality of vertically extending holes extending vertically within the interior of said adobe walls, which holes, after adequate curing of the adobe, were filled with concrete.

3. The apparatus of claim 1 wherein the reinforcing trusses are about six to eight inches apart.

4. The method of constructing a solid reinforced adobe wall comprising:

(a) setting posts at the end of said wall;

(b) stretching a tension member between the upper ends of said posts;

(c) hanging a plurality of bendable wire trusses over said tension member, the lower ends of which trusses can be embedded within a foundation for said wall and the upper ends of which can be attached to a roof member over said wall;

(d) hanging a pair of spaced wire mesh on said vertically extending wire trusses; and (e) forming the adobe wall around the wire trusses and wire mesh.

5. The method of claim 4 wherein the adobe wall is plastered onto the wire mesh.

6. The method of claim 4 wherein the adobe wall is formed by pouring the adobe into forms enclosing the wire trusses and wire mesh.

7. The method of claim 5 in which the wall has an opening therethrough comprising, in addition:

(1) the step of roughly framing said opening and placing said framing within the confines of said wire trusses and said wire mesh; and (2) affixing said framing to said trusses and mesh lying within the confines of said framing;

whereby the wire trusses extend vertically along the sides of said framing and wherein, after the wall is cured, the reinforcing members may be cut away within the framing.

* * * * *